United States Patent [19]

Gugel

[11] Patent Number: 4,822,187

[45] Date of Patent: Apr. 18, 1989

[54] PREVENTING ARMATURE REBOUNDING IN MATRIX PRINT HEADS

[75] Inventor: Bernd Gugel, Ulm-Einsingen, Fed. Rep. of Germany

[73] Assignee: Mannesmann AG, Duesseldorf, Fed. Rep. of Germany

[21] Appl. No.: 932,174

[22] Filed: Nov. 17, 1986

[30] Foreign Application Priority Data

Nov. 16, 1985 [DE] Fed. Rep. of Germany ..... 3540761

[51] Int. Cl.[4] ..... B41J 3/12

[52] U.S. Cl. ..... 400/124; 101/93.05

[58] Field of Search ..... 400/124; 101/93.05, 101/93.02, 93.04

[56] References Cited

U.S. PATENT DOCUMENTS

| | | | |
|---|---|---|---|
| 3,345,942 | 10/1967 | Meltz | 101/348 |
| 3,896,918 | 7/1975 | Schneider | 400/124 |
| 3,994,218 | 11/1976 | Riley | 400/157.3 |
| 4,049,107 | 9/1977 | Murat | 400/124 |
| 4,051,941 | 10/1977 | Hebert | 400/124 |
| 4,064,799 | 12/1977 | Babler | 400/157.3 |
| 4,209,260 | 6/1980 | Jung | 400/124 |
| 4,230,412 | 10/1980 | Hebert | 400/124 |
| 4,298,656 | 11/1981 | Mendelsohn | 428/414 |
| 4,613,243 | 9/1986 | Rossi et al. | 400/124 |
| 4,647,236 | 3/1987 | Moriya et al. | 400/124 |
| 4,746,130 | 5/1988 | Abele | 277/228 |

*Primary Examiner*—Edgar S. Burr
*Assistant Examiner*—James Lisehora
*Attorney, Agent, or Firm*—Ralf H. Siegemund

[57] ABSTRACT

Rebounding of armatures driving print needles in a matrix print head, the armatures being arranged in a star pattern, is prevented by having them abutting against a ring, preferably of fluoro rubber having hardness from 60 to 90 shore A and being bonded to a central sleeve, preferably made of aluminum, by two component adhesive that can withstand at least 100 degrees C, preferably epoxy resin and a modified amide.

1 Claim, 1 Drawing Sheet

PREVENTING ARMATURE REBOUNDING IN MATRIX PRINT HEADS

BACKGROUND OF THE INVENTION

The present invention relates to a matrix print head which includes print needles propelled towards a print medium by means of electromagnetic drivers whereby in dependence upon the selection of the drivers, characters are generated out of a plurality of dots as the print head passes transversely to the column arrangement of the front ends of the needles. It is assumed moreover that the needles are mounted in a housing and are guided therein, and that the drivers are mounted in the rear portion of the housing. These drivers include pivotable armatures and yokes mounted to a base plate which in turn is connected to a rear portion of the housing, the latter in turn is connected to (or integral with) the front housing part that contains and guides the needles.

Matrix print heads of the type to which the invention pertains have armatures which are pivotably mounted in the housing such as an armature abuts against a yoke arm associated with and being part of the respective driver. The armatures are arranged in a kind of star pattern, and the radial inner part of each armature is, on one hand, connected to (or engages) the respective print needle during a forward stroke of that needle, while in a return position on the armature abuts against an annular disk being axially positioned with respect to a mounting sleeve of the rear housing part.

Matrix print head of the type and variety mentioned above include particularly flat rings made of a resilient material serving as abutment disk for the armatures. The rings are resilient for purposes of attenuating vibrations as well as undesired rebounding of the armatures on their return. This feature is shown in U.S. Pat. No. 4,230,412. Such resilient flat rings are disadvantaged by the fact that they vary the air gap between the other end of the armature and the front end of the respective magnetic core. This air gap must have a very accurate value because its size determines the angle and path length of armature pivoting these parameters reflect directly on the stroke length over which the print needle is being propelled by the armatures. That path length determines specifically the path traversed by the needle tip to obtain the dot impact printing.

As the needle and armature are set into motion the mass of that moving system may in cases cause the tip of the needle to impact too hard upon the ribbon or the print medium or the platen. Upon return and impacting on the flat abutment rings one may acutally obtain rebounding of the armature and needle. The rebounding effect by and in itself introduces an undesirable delay into the system for the following reasons. The next forward stroke of the needle can begin only (a) after rebounding has stopped, i.e. (b) after the operative magnetic gap has been restored. Hence a delay may occur before satisfactory reenergization obtains and that in turn reduces the print frequency.

Moreover it has to be considered that it is necessary to move the ink ribbon transversely to the print medium so that in general at least two relative motions occur between any needle and that of the needle and head of the ribbon and ink ribbon. In extreme cases the ribbon may actually tear since the needle may still be in too much of a forward position while the ribbon is moved so that the needle may actually tear a hole into the ribbon.

Generally speaking, any rebounding of the needle or of the armature or both cannot be excluded. The resilient material of the flat abutment ring referred to above poses a specific problem as far as rebounding of the individual print needle is concerned. It was found, moreover, that print needles may undertake different stroke length on account of nonuniformity of the flat rings and that in turn deterioriates the appearance of the printed character. Finally it was found that the rebounding generally reduces the use like of the matrix print head.

DESCRIPTION OF THE INVENTION

It is an object of the present invention to improve matrix print heads of the type referred to above and to improve the aforementioned abutment rings such that rebounding of the needle and/or of the armature will not occur; the various problems delineated above will thus be avoided.

It is a specific object of the present invention to improve matrix print heads wherein electromagnetic drivers are arranged in a circle, and having armatures arranged in a star pattern and wherein the radially inner ends of the armatures are coupled to the rear ends of the print needles, radial outer ends of the armatures cooperate with core coil subassemblies of the drivers; all of the drivers are being mounted on a disk or ring from which extends a central sleeve carrying on its front end an abutment ring against which the radial inner ends of the armatures abut on return.

In accordance with the preferred embodiment of the present invention, it is therefore suggested to improve matrix print heads of the object variety such that the annular abutment ring against which the armatures abut and towards which they are pulled during a retraction stroke of the needles, is made of a vibration absorbing material with a shore hardness A between 60 and 90, and is bonded to that central mounting sleeve by means of a bonding agent which is capable of withstanding at least 100 degrees C. Such an arrangement and connection was found to be highly advantageous as a result of extensive and complex tests. After the tests, it was found that upon meeting the aforementioned requirement the stroke length of the needles are in fact uniform and rebounding has almost completely avoided, or at the least substantially reduced and the use life of such a head was drastically increased.

To the best of my knowledge the best attenuation is obtained if the annular disk is made of a fluorocauotchouc (rubber). The connection is to be made of a two component adhesive using an epoxy resin as binder and a modified amide as a curing agent. It was found that this kind of material will withstand more than 100 degrees C. Rebounding was avoided and the connection was found to hold if particularly a central mounting sleeve made of A1 or A1 alloy.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings FIG. 1 shows a platen 1 in relation to which a matrix print head is positioned. The print medium 1*a* (paper) is interposed between the head and bears against the platen and an ink ribbon 1*b* is interposed between the medium 1*a* and the print head. The platen 1 is configured, as usual, to be a cylindrical drum. The matrix print head can be considered to be biparted and includes a print needle driver group 2 and print needle adjusting and positioning group of elements 3.

Figure 1:
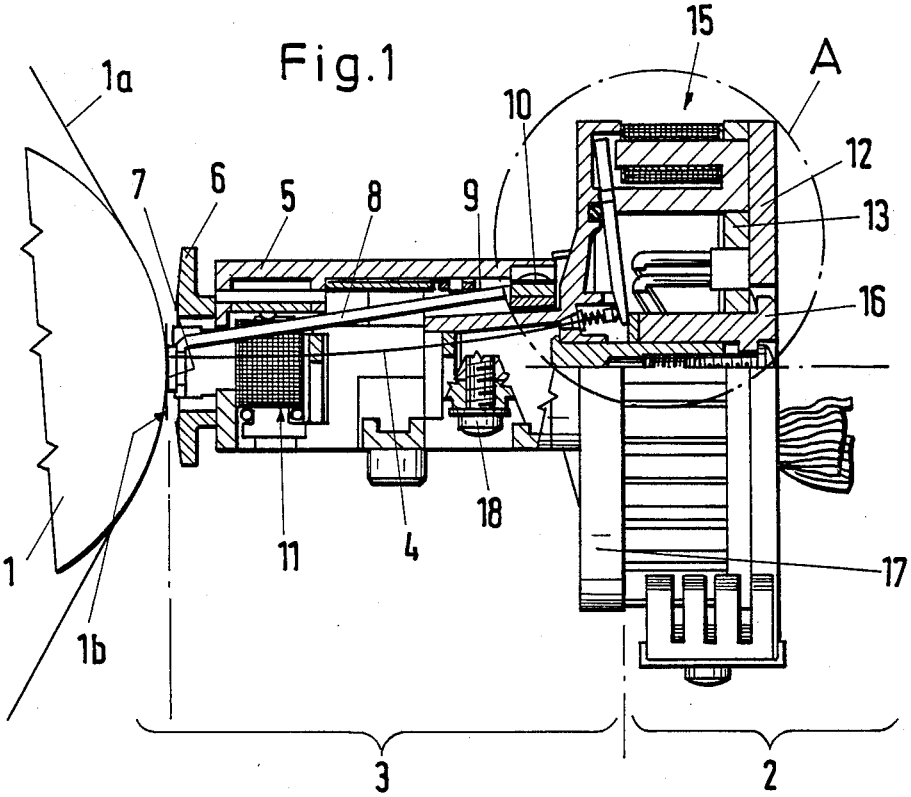
FIG. 1 is a longitudinal section view through a matrix print head improved in accordance with the preferred embodiment of the present invention.

The group 3 of elements is provided for adjusting a mount piece or mouth 7 in vertical direction i.e. in direction of and along the column in which the needle tips are arranged in mouth piece 7 and in the direction in which that column extends. This way one can operate the print head in a normal or high speed or draft speed or at a letter quality speed wherein each column is printed twice, and a shift of the mouthpiece 7 holding the needle tips occurs in between the two print heads and in the broadest possible sense.

The group 3 is described only in the most general terms since the inventive improvement dues not relate specifically to that group of elements and components. The groups 3 include a frontal housing 5 with a ribbon mask or guide 6 having an inner opening, and the mouth piece 7 referred to above is positioned in that opening. The mouth piece is fastened to a one end of a lever. The other end of that lever 8 is mounted in the rear of housing 5 by means of a leaf spring 9. The spring 9 is fastened to housing 5 by a screw 10. The leaf spring 9 establishes a playfree hinge.

The lever 8 is actuated i.e. pivoted by means of an electromagnet 11. Magnet 11 is positioned in the front part of housing 5. Depending on the energization of magnet 11 the lever 8 is either attracted towards a core of that magnet 11 (not illustrated) when the magnet is deenergized, or the lever 8 is moved away from the electromagnet by means of spring 9. The stroke length is very small and reflects the two different positions of the mouth piece 7. Examples for adjustment for such a mouth piece are shown for example in U.S. patent (Ser. No. 716,531, filed Mar. 27, 1985—allowed; see also German printed patent application No. 34 12 856).

The needle drive group 2 is provided for moving the print needles 4 generally in the direction of their length extension which translate into tip movement and is the direction of printing when the tips move in and out of the mouth piece 7, towards and away from the ribbon 1b, the print medium 1a and the platen 1. In order to obtain this print movement a plurality of drivers 15 are arranged as the principal components of group 2. Those drivers are arranged on a circle around a central axis 30. These drivers 15 individually propel the needles 4 forward, towards the platen. The drivers 15 are mounted on end plate 12 constituting a part of the rear housing or housing portion. Each drive includes a core element 14*a*, a return platen and armature mounting yoke 14*c* and a coil 14*b*. One can also say that 14*c* and 14*a* constitute a yoke element with two legs wherein the outer legs 14*a* of each yoke pair carries the electromagnetic coil 14*b*. There are as many coils and yoke cores as there are needles. The yoke elements are mounted on the end plate 12 and together with a base plate 13 establish a magnetic block.

Figure 2:
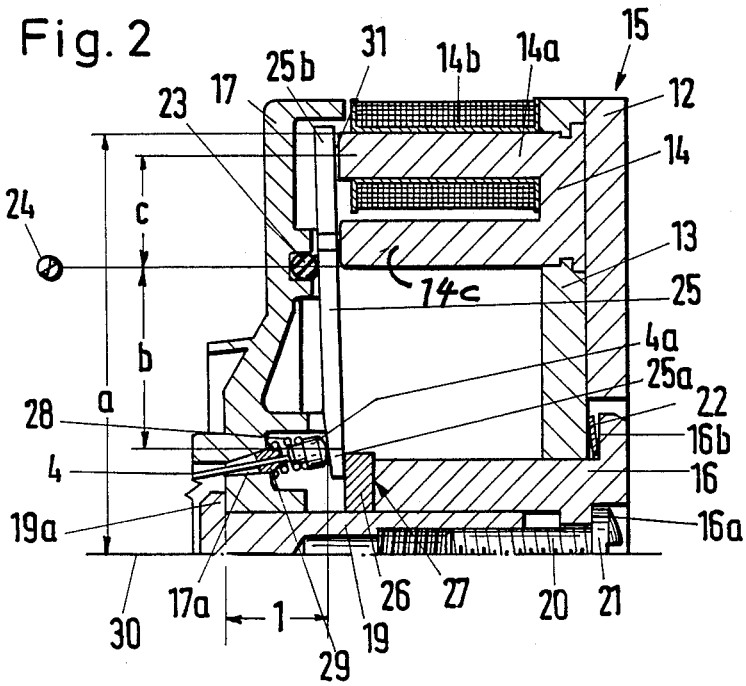
FIG. 2 is an enlarged view of the portion identified by A in FIG. 1.

A sleeve 16 is inserted in and traverses the base plate 13. A bolt 20 having a head 21 holds the sleeves 16 against plate 13, particularly by operation of a flange 16*b* there being a spring 22 interposed between the flange 16*b* and plate 13. Reference numeral 17 refers to the rear part of the housing, and that housing part 17 is connected to the frontal housing part 5 by means of screws 18. A centering sleeve 19 (see FIG. 2) is inserted in the rear housing 17 and it extends into the sleeve 16. The screw 20 is inserted in the sleeve 19 and the head 21 and bears against an annular step 16*a* of the sleeve 16. This screw 20 pulls the centering sleeve 19 with its annular flange 19*a* against the housing part 17, while the step 16*a* of the sleeve 16 engages bolt head 21. This way one obtains a unit between the rear housing part 17 and of the magnet elements mounted on housing part 12. The resilient disk 22 causes the sleeve 16 to work against the force of the screw 20.

An O ring 23 is disposed inside a groove in housing part 17 and establishes a pivot mount 24 for armatures 25. These armatures each have a front (radial inner) end 25*a*, and the heads 4a of the needles 4 snugly bear against that end 25*a* from one side. The other side of an armature end, 25*a*, bears against an annular, disk shaped abutment 26. The abutment disk or ring 26 is made of flurorubber. Reference numeral 27 refers to a temperature resisting adhesive by means of which the abutment ring 26 is bonded to the front end of the sleeve 16. A particular material was mentioned in the introduction and the minimum temperature this adhesive has to withstand is 100 degrees C. In the retracted position of the needles as the respective needle heads 4*a* bear against the front end 25*a* of one of the armatures 25 that end 25*a* abuts ring 26. The needles heads 4*a* are particularly urged by means of coil springs 28 against the armature 25*a* which in turn is urged therewith against the ring 26. On the other hand the coil springs each bear against a support 29 of hanging part 17 and concentric to the needle bores 17*a* within the rear housing part 17. The position of the needle bars 17*a* with reference to the armatures 25 are predetermined on account of the particular disposition 1. The pivot mount 24 establishes, as indicated in the figures, a distance a being specifically the distance of the other, radial outer end 25*b* of an armature 25 from the center axis 30 of the system. b is the distance from the pivot mount 24 to the center of the respective needle head 4*a* upon abutment of that head against the front or radial inner end 25*a* of the respective armature c denotes the distance from the pivot mount 24 to the rear, radial outer end 25*b* of the armature 25.

The dimensions a,b,c, determine force and energy involved in the operation of the device whenever the armature hits the abutment ring 26 at a rate in excess of 800 Hertz. The particular abutment ring 26 having characteristics given by the material involved on one hand and the dimensions of that ring on the other hand and furthermore the effect of the particular bonding agent employed all cause the impact of the armature against that ring 26 to be attenuated to such an extent that it will not noticeably rebound. Here is it important that the air gap 31 is determined between the armature end 25*b* and the yoke leg or coil 14*a*. That 31 gap is originally adjusted highly accurately since it is an important determining factor in the force by means of which the armature is attracted and that in turn bears directly on the temporal characteristics of armature actuation. During a large number of pulses the gap 31 must always be the same in the beginning of what will become a forward stroke. The beginning is given by an electric current pulse through the respective electromagnetic coil 14b, and it is of course critical that with the beginning of a forward stroke the gap 31 is always the same. This means that the gap must not be modified by a rebounding effect of the armature. Any rebounding either must not occur, as is the case on practicing the invention, or rebounding must have decayed prior to the next actuation. If one has to wait for such a decay of rebounding cycles such waiting reduces the number of print pulses which can be processed per unit time. It is thus apparent that a complete avoidance of rebounding means that at the moment the tip 25*a* hits the ring 26 the gap 31 in its initial dimension is restored and that in turn means that a new forward stroke can begin right then and there.

The detailed configuration of the group 3 is another primary importance with regard to the energy consumption of the coils 14*b* as cooperating with the armatures 25 and the needles 4. The overall configuration of the group 3 establishes a kind of constructive feedback upon the configuration of the group 2. This means that a certain negative (detrimental) feedback in a general sense of the group 3 upon the group 2 is not completely avoidable. Therefore the group 3 can be configured differently from the one shown and described. The particular construction chosen has a variety of advantages that have no bearing on the aspects under consideration. It is for example important to provide for the biparted housing. Also, the connection between the rear housing part 17 and the centering sleeve 19 through the screw 20 is extremely important as far as the adjustment and attainment of particular air gaps 31 are concerned. The resilient disk 22 serves as adjusting reference. It is possible to disregard the group 3 entirely i.e. to run the needles 4 in a conventional manner inside a single piece housing which has been established through by uniform structure. One can also provide the usual guide structure up to the mouthpiece 7 for each of the individual needles. Moreover one can practice the invention if the group of needles, i.e. the mouthpiece 7, is not adjustable at all. The example above simply is believed to constitute the best mode of practicing the invention as far as overall configuration and current development of a new matrix print head is concerned.

The invention is not limited to the embodiments described above but all changes and modifications thereof not constituting departures from the spirit and scope of the invention are intended to be included.

I claim:

1. In a matrix print head having a plurality of print needles, a plurality of circularly electromagnetic drives respectively associated with the needles of the plurality and each including an armature pivotally operated by the respective energizing portion of the drive and having a radial inner end operatively connected to the rear end of the needle, a tip of each needle being provided for printing a dot there being a plurality of such armatures arranged accordingly and in a star pattern around a center, there being in addition a central sleeve being concentric in relation to and part of the mounting structures of the electromagnetic energizing portion of the circularly arranged drives, the improvement comprising:

said sleeve is made of A1 or A1 alloy;

an annular element provided as a stop for the radial inner ends of the armatures and against which the armatures are moved for abutment upon retraction of the print needles said annular element being made of fluoro-rubber material to absorb any vibrations the armature may tend to undergo and having a hardness between 60 shore A and 90 shore A, and being adhesively bonded to said sleeve by means of an adhesive bonding agent that can withstand at least 100 degrees C, said adhesive is a two component adhesive having an epoxy resin as binder and a modified amide as curing agent.

* * * * *